US005893661A

United States Patent [19]

Sakai et al.

[11] Patent Number: 5,893,661

[45] Date of Patent: Apr. 13, 1999

[54] IMAGE FORMING APPARATUS

[75] Inventors: Tetsuya Sakai; Yasuo Tanaka; Kazuyoshi Hara, all of Aichi-Ken, Japan

[73] Assignee: Minolta Co., Ltd., Osaka, Japan

[21] Appl. No.: 09/065,419

[22] Filed: Apr. 24, 1998

[30] Foreign Application Priority Data

Apr. 26, 1997 [JP] Japan ..... 9-123240

[51] Int. Cl.[6] ..... G03G 15/14

[52] U.S. Cl. ..... 399/66; 399/45; 399/314

[58] Field of Search ..... 399/45, 66, 297, 399/314, 37; 361/225; 323/282

[56] References Cited

U.S. PATENT DOCUMENTS

| | | | |
|---|---|---|---|
| 5,253,022 | 10/1993 | Takeuchi et al. | 399/66 X |
| 5,331,383 | 7/1994 | Nou et al. | 399/314 X |
| 5,546,172 | 8/1996 | Seto | 399/37 X |
| 5,729,811 | 3/1998 | Takahata et al. | 399/316 |

FOREIGN PATENT DOCUMENTS

| | | |
|---|---|---|
| 04258980 | 9/1992 | Japan . |
| 05289463 | 11/1993 | Japan . |
| 5-333722 | 12/1993 | Japan . |

*Primary Examiner*—Arthur T. Grimley
*Assistant Examiner*—Sophia S. Chen
*Attorney, Agent, or Firm*—McDermott, Will & Emery

[57] ABSTRACT

An image forming apparatus using the electrophotographic method in which a toner image formed on an image carrier is transferred to a transfer medium, the image forming apparatus being equipped with a fixed-voltage transfer controller that controls the transfer voltage such that it will be maintained at a prescribed voltage, a current detector that detects the transfer current, a voltage detector that detects the transfer voltage, and a switching controller that, when the transfer current detected by means of the current detector falls outside a prescribed range, switches from fixed-voltage transfer control performed by the fixed-voltage transfer controller to fixed-current transfer control in which the transfer current is controlled such that the transfer current will be maintained at a prescribed control current, the image forming apparatus performing optimal image transfer at all times by, after the switching, setting as a new voltage level the voltage level detected by means of the voltage detector while the fixed-current transfer control is active, and then returning once again to fixed-voltage transfer control by means of the fixed-voltage transfer controller.

13 Claims, 4 Drawing Sheets

IMAGE FORMING APPARATUS

RELATED APPLICATION

This application is based on application No. Hei 9-123240 filed in Japan, the content of which is hereby incorporated by reference.

BACKGROUND OF THE INVENTION

1. Field of the Invention

The present invention pertains to an image forming apparatus using the electrophotographic method, and more particularly, to an image forming apparatus in which a transfer control method has a unique feature.

2. Description of the Related Art

In an image forming apparatus using the electrophotographic method, for the transfer control used when a toner image that is obtained by developing a latent image formed on the photoreceptor by means of toner is transferred to a transfer medium, a fixed-voltage transfer control method or a fixed-current transfer control method is used. The fixed-voltage transfer control method is a method that performs control such that the detected transfer voltage level is maintained at a prescribed voltage level. The fixed-current transfer control method is a method that performs control such that the detected transfer current level is maintained at a prescribed current level.

In Japanese Laid-Open Patent Application Hei 4-258980, an image forming apparatus is disclosed which performs transfer control by detecting the output current level to perform calculation and by obtaining the target output voltage level based on the result of calculation and the output voltage level.

The image forming apparatus disclosed in Japanese Laid-Open Patent Application Hei 5-289463 determines the transfer current immediately before the print sequence from the charge level of the toner developing area, and detects the resistance of the transfer medium before it reaches the transfer area. The transfer charge level is then estimated from the product of this resistance and the transfer current. In other words, it discloses a system in which image forming parameters such as discharge, charge, exposure, development, etc., are changed such that the sum of the charge level of the toner developing area and the transfer charge falls within an allowable range.

In an image forming apparatus using the electrophotographic method, it is known that due to differences between systems and in the gradation method used, as well as due to differences in environmental conditions, durability, darkness level set by the user, etc., the amount of toner adhering to the photoreceptor per unit area (hereinafter termed simply 'adhering toner amount') is around 0.7 mg/cm$^2$, and can vary within a range of approximately 0.4 mg/cm$^2$ to 1.0 mg/cm$^2$.

FIG. 2 shows the I-V characteristic when a solid toner image is transferred to a regular sheet of A4 size paper by means of the contact transfer method employing a transfer roller. B1, B2 and B3 represent the characteristic when the amount of toner adhering to the photoreceptor is 0.4 mg/cm$^2$, 0.7 mg/cm$^2$ and 1.0 mg/cm$^2$, in that order. The level of toner charge is more or less fixed. The darkened part of each characteristic curve indicates the best transfer efficiency range (hereinafter termed the 'proper range') obtained regarding the adhering toner amount represented by each curve.

Below the proper range, the transfer output becomes too low and transfer problems such as the image becoming blurred occur. Above the proper range, the transfer output becomes too high and transfer problems such as discharge noise occur. This proper range varies depending on the adhering toner amount, as shown in the drawing. FIG. 2 is a drawing showing the characteristic for regular A4 paper immediately after it was taken out of its package, and the characteristic for other types of transfer medium would differ from that shown in the drawing. For example, where the paper has absorbed moisture, even when it is regular paper, the required transfer voltage level is smaller. Where the transfer medium comprises thick paper or an OHP transparency, the resistance level is larger than that for regular paper, and therefore, the necessary transfer voltage level rises.

In the conventional fixed-voltage transfer control method, the transfer voltage is controlled such that it will comprise a control voltage level V2 falling within the proper range when the adhering toner amount is 0.7 mg/cm$^2$. As a result, if the overall adhering toner amount deviates from 0.7 mg/cm$^2$ and the resistance of the transfer medium varies, the paper assumes a characteristic different from the B2 characteristic shown in FIG. 2. Consequently, the transfer voltage level controlled to be voltage V2 falls outside the proper range for this different characteristic, and as a result, good transfer efficiency can no longer be obtained. In other words, while the conventional fixed-voltage transfer control method has little susceptibility to localized non-uniformity with regard to the image pattern and B/W ratio (black/white ratio), it is easily affected by the overall change in resistance of the transfer medium which varies depending on the type of the transfer medium or in response to the environment.

The conventional fixed-current control method is capable of performing control even when the adhering toner amount generally deviates from 0.7 mg/cm$^2$ or when the overall resistance of the transfer medium changes. However, in the case of FIG. 3(*b*), where a blank area and a patterned area coexist within the range of the transfer nip, i.e., when localized non-uniformity exists, more charge flows to the blank area as shown in the drawing, and consequently, the charge that should flow to the patterned area falls short, which easily leads to transfer failure. If the control current level is set high in order to prevent this problem, excessive charge flows when the solid area is transferred, which leads to the occurrence of pre-transfer discharge and therefore, discharge noise in the image. In other words, while the conventional fixed-current transfer control method has little susceptibility to an overall change in resistance, it is easily affected by a localized change in resistance caused by the image pattern or the B/W ratio, which easily leads to poor transfer efficiency. Such a problem is particularly marked during color image formation where the toner layer becomes thick. FIG. 3(*a*) is showing the flow of charge in a solid image area.

SUMMARY OF THE INVENTION

The object of the present invention is to solve the problems described above.

Another object of the present invention is to provide an image forming apparatus that can perform proper image transfer irrespective of the type of image to be transferred or the type of transfer medium.

The further object of the present invention is to prevent the occurrence of transfer failures caused by (i) variation in the thickness of the toner layer (due to variation in the adhering toner amount, variation due to multi-gradation development, variation due to a toner image in which multiple developers overlap in localized areas), (ii) a localized variation such as a variation in the B/W ratio of the image pattern, or (iii) an overall change in resistance level due to the type of transfer medium, etc.

The further object of the present invention is to provide an image forming apparatus that can effectively maintain transfer efficiency by preventing problems such as image blurring, discharge noise, deterioration in color reproduction, etc.

The further object of the present invention is to prevent damage to the apparatus by preventing electrostatic destruction caused by an abnormal rise in the transfer voltage level.

These and other objects are attained by means of an image forming apparatus using the electrophotographic method in which a toner image formed on an image carrier is transferred to a transfer medium, the image forming apparatus being equipped with a fixed-voltage transfer controller that controls the transfer voltage such that it will be maintained at a prescribed level, a current detector that detects the transfer current level, a voltage detector that detects the transfer voltage level, and a switching controller that, when the transfer current level detected by means of the current detector falls outside a prescribed range, (i) switches from fixed-voltage transfer control performed by the fixed-voltage transfer controller to fixed-current transfer control in which the transfer current is controlled such that the transfer current level will be maintained at a prescribed control level, (ii) sets as a new control voltage level the transfer voltage level detected by means of the voltage detector while the fixed-current transfer control is active, and then (iii) returns to fixed-voltage transfer control by means of the fixed-voltage transfer controller.

The objects of the present invention are further attained by means of an image forming apparatus equipped with an image carrier, an image forming device that forms a toner image on the image carrier, a transfer device that electrically transfers the formed toner image onto a transfer medium, a current detector that detects the transfer current level, a voltage detector that detects the transfer voltage level, a fixed-voltage transfer controller that controls the transfer voltage such that the detected transfer voltage will be maintained at a prescribed level, a fixed-current transfer controller that controls the transfer current such that the detected transfer current will be maintained at a prescribed level, and a first switching controller that, when the detected transfer current level falls outside a prescribed range, switches control from control by the fixed-voltage transfer controller to control by the fixed-current transfer controller.

The invention itself, together with further objects and attendant advantages, will best be understood by reference to the following detailed description taken in conjunction with the accompanying drawings.

BRIEF DESCRIPTION OF THE DRAWINGS

FIG. 3(*b*) is a drawing showing the flow of charge in a patched area.

In the following description, like parts are designated by like reference numbers throughout the several drawings.

DETAILED DESCRIPTION OF THE PREFERRED EMBODIMENT

Figure 1:
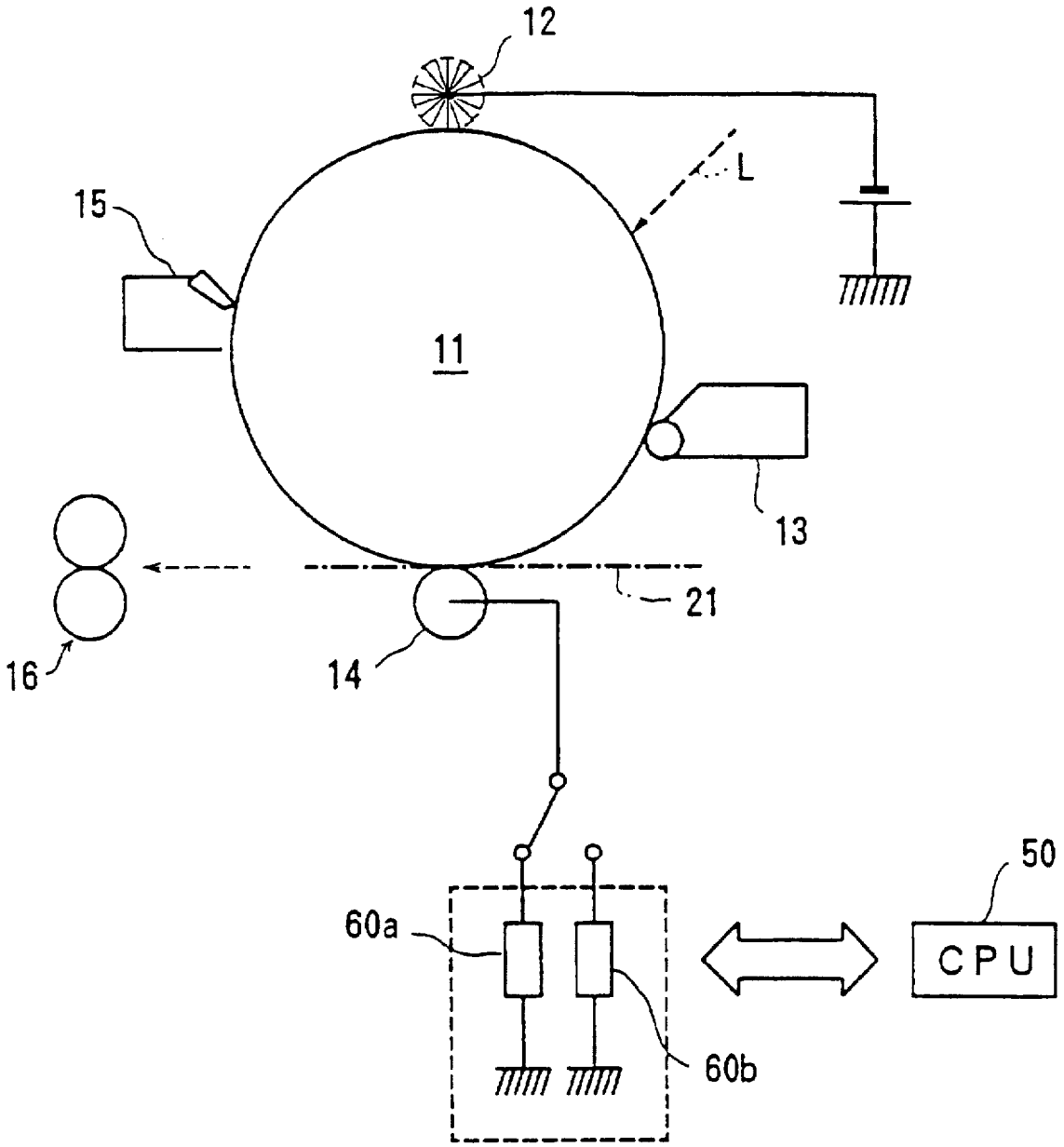
FIG. 1 is a simplified drawing of the essential parts of an image forming apparatus.

FIG. 1 is a simplified drawing showing the construction of the image forming apparatus pertaining to this embodiment. This apparatus is an image forming apparatus that forms images using the electrophotographic method. In other words, after the surface of photoreceptor drum 11 that rotates at a fixed speed is uniformly charged by charger 12, the image is exposed (L indicates image exposure via a laser beam, etc., modulated based on the image reflection light and image data) to form an electrostatic latent image. This electrostatic latent image is then developed into a toner image by means of toner developing device 13, and this toner image is transferred to the surface of transfer medium 21 by means of transfer roller 14. After this toner image transfer, transfer medium 21 is sent to fusing device 16 and image fusing using heat and pressure is performed by means of the fusing device 16. The toner remaining on the surface of photoreceptor drum 11 after toner image transfer is cleaned off by cleaner 15.

Transfer roller 14 is normally subject to fixed-voltage transfer control by means of fixed-voltage transfer controller 60*a* driven in response to instructions from CPU 50, but at the appropriate tine, control switches to fixed-current transfer control by means of fixed-current transfer controller 60*b* in response to instructions from CPU 50. The transfer voltage level detected under this fixed-current transfer control is then set as a new control voltage level, and control is then returned once again to fixed-voltage transfer control by means of fixed-voltage transfer controller 60*a*. The shorter the period before this return to fixed-voltage transfer control, the better. As a practical matter, fixed-current control is performed only for a period ranging from tens of milliseconds to hundreds of milliseconds.

Figure 4:
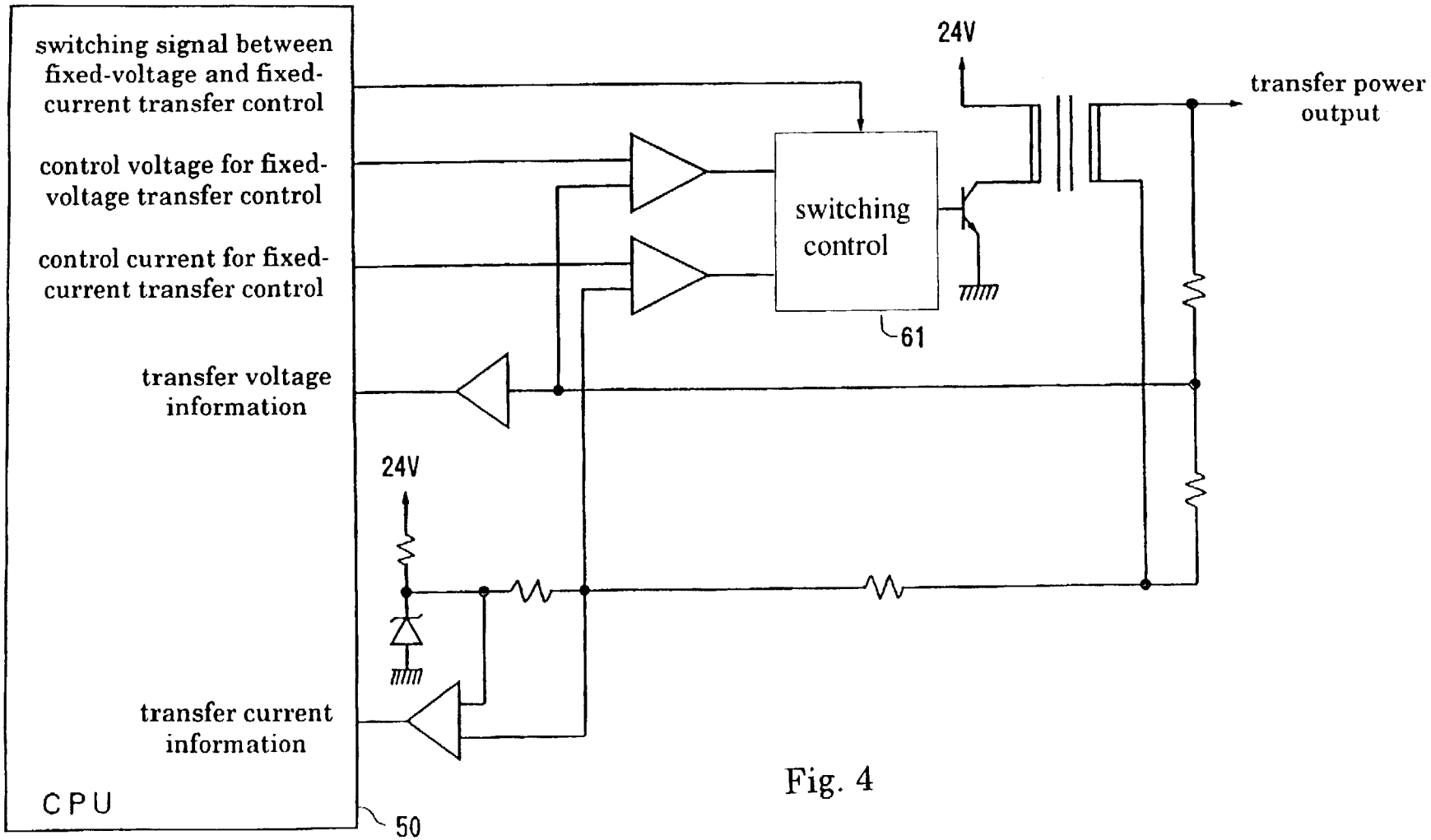
FIG. 4 is a block diagram showing the transfer control unit.

FIG. 4 shows the construction of the transfer control unit performing the control described above.

CPU 50 normally sends signals for the performance of fixed-voltage transfer control to switching controller 61. Based on these signals, switching controller 61 performs control so that the detected voltage level of the transfer output from the transformer will be equal to a control voltage level. This control voltage level is supplied by CPU 50, and in the present apparatus, the initial level is voltage level V2 corresponding to midpoint level $I_0$ between the current levels $I_{max}$ to $I_{min}$ comprising the optimal range which is shared by the proper ranges described above (the range common to the darkened ranges in curves B1 through B3 in FIG. 2, the details of which will be described below).

The transfer voltage level and transfer current level are input to CPU 50 and monitored at all times by voltage detecting means and current detecting means, respectively, in the CPU 50. If the transfer current level falls outside optimal range $I_{max}$ to $I_{min}$ described above, CPU 50 sends a signal to switching controller 61, instructing it to switch to fixed-current transfer control, and supplies switching controller 61 the midpoint level $I_0$ within the optimal range described above as the control current level. Based on this signal, switching controller 61 performs control so that the detected current level will equal control current level $I_0$.

When the detected current level equals control current level $I_0$, CPU 50 sets the detected transfer voltage level as the control voltage level and supplies it to switching controller 61. It then sends a signal to switching controller 61, instructing it to switch to fixed-voltage transfer control. Based on this signal, switching controller 61 performs fixed-voltage transfer control once more so that the detected voltage level will become the newly-set control voltage level.

Where the detected voltage level reaches a prescribed maximum level $V_{max}$ before the detected current level equals control current level $I_0$, this maximum level $V_{max}$ is set as the new control voltage level and supplied to switching controller 61, and fixed-voltage transfer control is performed based on this maximum level $V_{max}$. This type of control is performed in order to prevent the apparatus from malfunctioning due to leakage, etc. from the transfer device that may be caused by the application of abnormally high voltage when the detected transfer current level does not rise due to some sort of abnormality.

Figure 2:
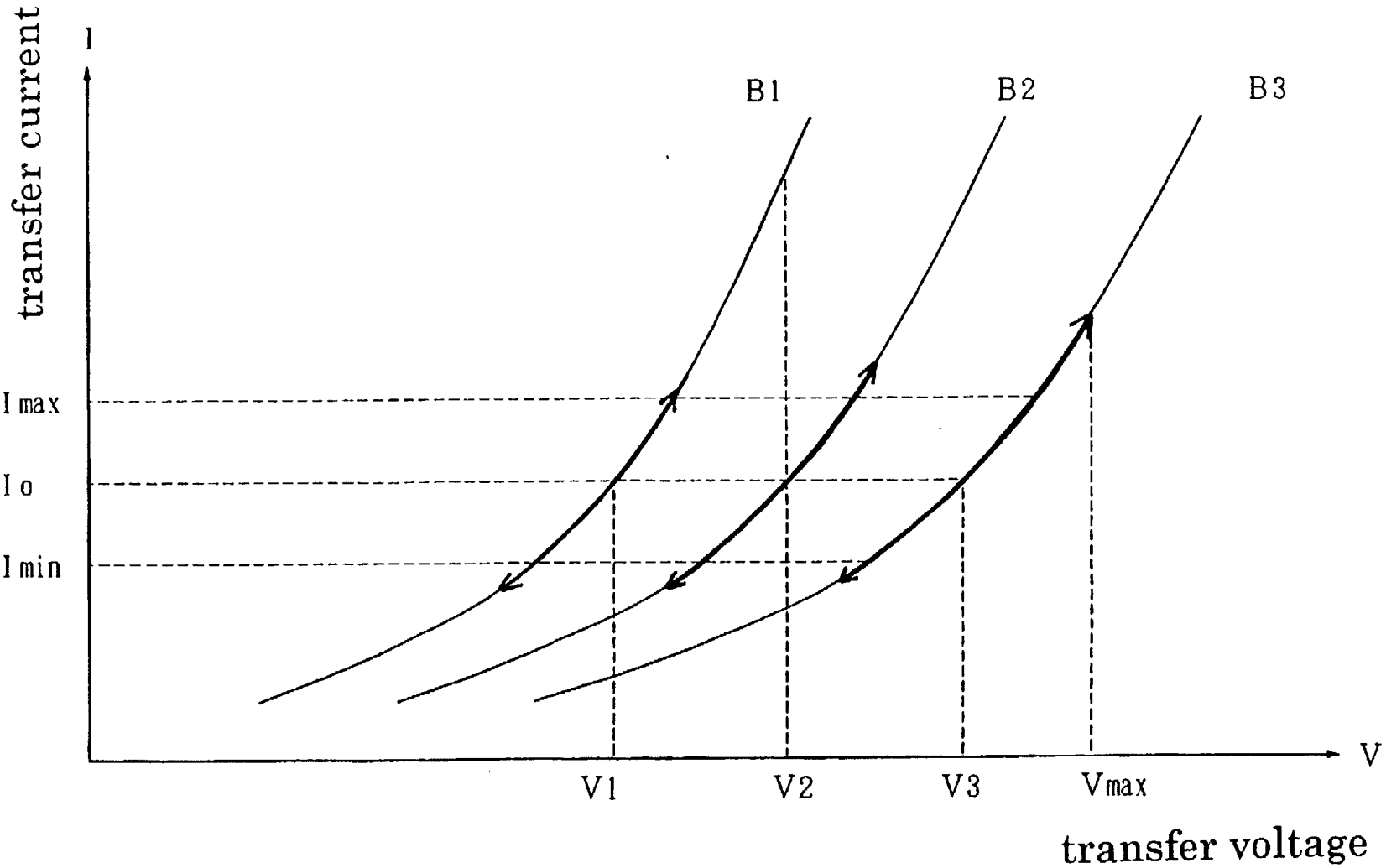
FIG. 2 is a drawing of the I-V characteristic of the transfer unit showing the adhering toner amount as a parameter.
Figure 3:
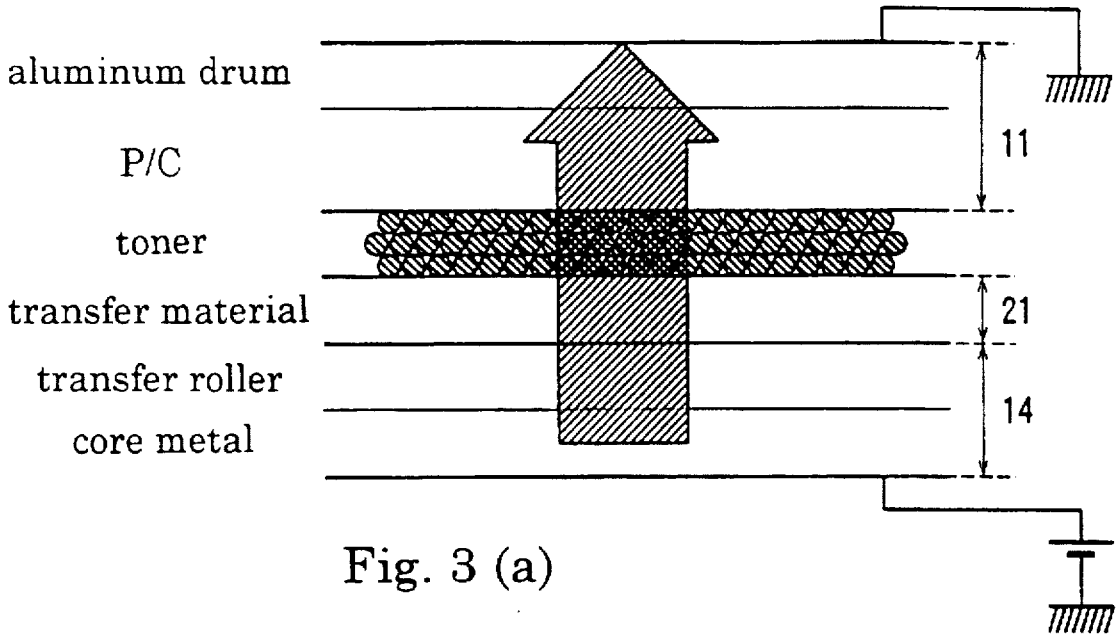
FIG. 3(*a*) is a drawing showing the flow of charge in a solid image area.
Figure 3:
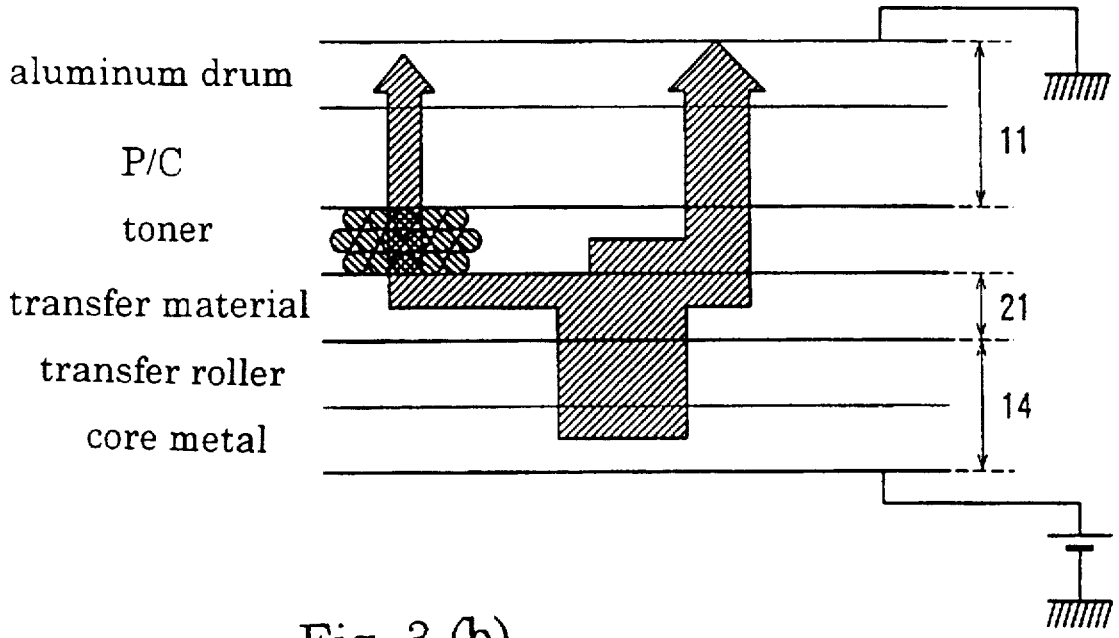

Control of the present apparatus will now be explained with reference to the I-V characteristic drawing (FIG. 2).

There are areas having a large adhering toner amount and areas having a small adhering toner amount along the length of the nipping area where contact transfer takes place, and the proper range described above varies from area to area. In order to obtain good transfer efficiency across the entire length of the nipping area, control should be performed such that the current level falls within optimal range $I_{max}$ to $I_{min}$, which is common to the proper ranges of the B1 through B3 characteristic curves described above (the darkened parts). Here, $I_{max}$ is a maximum current level, and is the highest current level in the proper range (the darkened part) for 0.4 mg/cm$^2$ toner adhesion, for example. $I_{min}$ is a minimum current level, and is the lowest current level in the proper range (the darkened part) for 0.1 mg/cm$^2$ toner adhesion, for example.

In order to perform the control, initially, voltage level V2 corresponding to midpoint level $I_0$ within optimal range $I_{max}$ to $I_{min}$ is set as the control voltage level, for example, and fixed-voltage transfer control is performed. It is also acceptable if a proper level falling within the voltage range corresponding to optimal range $I_{max}$ to $I_{min}$, such as the midpoint level of the proper range for 0.7 mg/cm$^2$ toner adhesion, is adopted as the control voltage level. The fixed-voltage transfer control in which V2 is used as the control voltage level will be termed 'fixed-voltage V2 control' hereunder.

During fixed-voltage V2 control, when a part having the 1.0 mg/cm$^2$ characteristic enters the nipping area, the transfer current level becomes lower than the lower limit $I_{min}$ of optimal range $I_{max}$ to $I_{min}$, thereby falling outside of the range. In the characteristic chart, this corresponds to the fact that the point of intersection of control voltage level V2 and characteristic curve B3 for 1.0 mg/cm$^2$ toner adhesion is lower than $I_{min}$.

Because the transfer current level is monitored by CPU 50 at all times, where the detected transfer current level falls outside optimal range $I_{max}$ to $I_{min}$, CPU 50 switches transfer control to fixed-current transfer control. Midpoint level $I_0$ within optimal range $I_{max}$ to $I_{min}$, for example, is set as the control current level in this situation. It is also acceptable if an appropriate level falling within optimal range $I_{max}$ to $I_{min}$, such as the midpoint level of the proper range for the 0.7 mg/cm$^2$ toner adhesion, is adopted as the control current level.

The transfer voltage level is also monitored by CPU 50, and where switching to fixed-current $I_0$ control is performed as described above, the detected transfer voltage level V3 at that time is set as the new control voltage level, and transfer control is switched once again to fixed-voltage transfer control. In other words, switching to fixed-voltage V3 control is performed.

During fixed-voltage V3 control, when, for example, the part having the 0.4 mg/cm$^2$ characteristic enters the nipping area, the transfer current level becomes higher than the upper limit $I_{max}$ of optimal range $I_{max}$ to $I_{min}$, thereby falling outside of the range. In the characteristic chart, this corresponds to the fact that the point of intersection of control voltage level V3 and characteristic curve B1 for 0.4 mg/cm$^2$ toner adhesion (which is not in the range shown in the graph) is higher than $I_{max}$.

Because the transfer current level is monitored by CPU 50 at all times, where the detected transfer current level falls outside optimal range $I_{max}$ to $I_{min}$, CPU 50 switches transfer control once more to fixed-current transfer control (fixed-current $I_0$ control). Further, the transfer voltage level detected when this switching takes place is set as the new control voltage level (V1 in this case), and transfer control is switched once again to fixed-voltage transfer control. In other words, switching to fixed-voltage V1 control is performed.

In other words, where the detected current level falls outside optimal range $I_{max}$ to $I_{min}$ during fixed-voltage transfer control, control is temporarily switched to fixed-current transfer control that uses as the control current level a representative proper current level close to the midpoint of optimal range $I_{max}$ to $I_{min}$, and the transfer voltage level at that time is detected. Transfer control is then performed such that switching to fixed-voltage transfer control using the detected voltage level as the new control voltage level is performed in the present apparatus.

Because of the control switching, good transfer efficiency can be maintained even where the adhering toner amount varies in different locations, or where a toner image using multiple gradations or comprising multiple developers in some areas is transferred, as well as where the overall resistance of the transfer medium changes, and thus transfer failures may be prevented. Further, in the case of blank areas, the occurrence of background fog can be prevented.

In the present apparatus, during control described above, the upper limit level $V_{max}$ is set with regard to the transfer voltage level. In other words, when control is temporarily switched from fixed-voltage transfer control to fixed-current $I_0$ control as described above, it sometimes occurs that a problem arises in the transfer area, etc., and an abnormally high voltage becomes necessary to detect current level $I_0$. The upper limit level $V_{max}$ is set in order to prevent the apparatus from falling due to leakage, etc., from the transfer device in such a situation. When the detected voltage level reaches upper limit level $V_{max}$, control is switched to fixed-voltage transfer control at that time so that fixed-voltage $V_{max}$ control is performed. For upper limit level $V_{max}$, the maximum level in the proper range for the 1.0 mg/cm$^2$ characteristic, which is a situation where the adhering toner amount is the largest, may be used.

Optimal range $I_{max}$ to $I_{min}$ in the explanation provided above may change depending on the size, thickness or type of the transfer medium. If such a change occurs, optimal transfer control may be performed by changing optimal range $I_{max}$ to $I_{min}$ and/or control current level $I_0$ such that they correspond to the change.

For example, where the transfer medium, which may be a sheet of paper or an OHP transparency, is small, the area at which the transfer medium does not exist and therefore has a low resistance becomes large inside the transfer nipping area, and an even larger charge flows to this low-resistance area than in the case of blank areas described above. Consequently, insufficient charge occurs in the image area and as a result a transfer problem easily occurs. Therefore, in the case of a small transfer medium, it is recommended that optimal range $I_{max}$ to $I_{min}$ and control current level $I_0$ be set higher than for a normal-sized transfer medium.

In addition, depending on the type of the transfer medium, i.e., depending on the level of resistance, or depending on the system speed determined by the fusion characteristic, optimal range $I_{max}$ to $I_{min}$ and control current level $I_0$ should be set high or low (i.e., when such parameters are high, optimal range $I_{max}$ to $I_{min}$ and control current level $I_0$ should be set high, and when the parameters are low, they should be set low as well). As a result, good transfer efficiency may be obtained.

While the explanation provided above describes a situation in which a transfer roller is used, the present invention may be applied in the same manner to the intermediate transfer belt method, transfer conveyance belt method, or transfer drum method. Further, the present invention may be applied regardless whether the image forming apparatus is a monochrome or color apparatus.

In the embodiment described above, when the thickness of the toner layer changes (due to variation in the adhering toner amount, variation due to multi-gradation development, variation due to a toner image in which multiple developers overlap in localized areas), when a localized variation such as a variation in the B/W ratio of the image pattern occurs, or when the resistance level changes depending on the type of transfer medium, etc., the control voltage level for fixed-voltage transfer control is changed in order to accommodate the change. Consequently, the occurrence of transfer failures caused by these variations may be prevented, which in turn prevents image blurring, discharge noise and deterioration in color reproduction, and transfer efficiency may be effectively maintained. In addition, since electrostatic destruction by virtue of an abnormal increase in the transfer voltage may be prevented, damage to the apparatus that could be caused by the electrostatic destruction may be prevented.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus in which a toner image formed on an image carrier is transferred to a transfer medium, said image forming apparatus comprising:

fixed-voltage transfer control means that controls a transfer voltage such that it will be maintained at a prescribed voltage;

current detecting means that detects a transfer current;

voltage detecting means that detects a transfer voltage, and switching means that, when the transfer current detected by said current detecting means falls outside a prescribed range, (i) switches from fixed-voltage transfer control performed by said fixed-voltage transfer control means to fixed-current transfer control in which the transfer current is controlled such that the transfer current will be maintained at a prescribed control current, (ii) sets as a new control voltage the transfer voltage detected by said voltage detecting means while said fixed-current transfer control is active, and then (iii) returns to fixed-voltage transfer control by said fixed-voltage transfer control means.

2. An image forming apparatus of claim 1, wherein said prescribed range is altered based on a kind of the transfer medium.

3. An image forming apparatus of claim 1, wherein said switching means, where a transfer voltage detected during the fixed-current transfer control exceeds a prescribed threshold voltage, sets said prescribed threshold voltage as a new control voltage, and then returns control to the fixed-voltage transfer control by said fixed-voltage transfer control means.

4. An image forming apparatus, comprising:

an image carrier;

image forming means that forms a toner image on said image carrier;

transfer means that electrically transfers a formed toner image onto a transfer medium;

current detecting means that detects a transfer current;

voltage detecting means that detects a transfer voltage;

fixed-voltage transfer control means that controls a transfer voltage such that the detected transfer voltage will be maintained at a prescribed voltage;

fixed-current transfer control means that controls a transfer current such that the detected transfer current will be maintained at a prescribed current; and first switching means that, when the detected transfer current falls outside a prescribed range, switches control from control by said fixed-voltage transfer control means to control by said fixed-current transfer control means.

5. An image forming apparatus of claim 4, further comprising:

second switching means that returns control from control by the fixed-current transfer control means to control by the fixed-voltage transfer control means.

6. An image forming apparatus of claim 5, wherein said fixed-voltage transfer control means, after said second switching means returns control to control by the fixed-voltage transfer control means, controls a transfer voltage such that the detected transfer voltage will be maintained at a transfer voltage which has been detected under the control by the fixed-current transfer control means.

7. An image forming apparatus of claim 4, further comprising:

third switching means that, where a transfer voltage detected during the fixed-current transfer control exceeds a prescribed threshold voltage, sets said prescribed threshold voltage as a new control voltage, and then returns control to the fixed-voltage transfer control by said fixed-voltage transfer control means.

8. An image forming apparatus of claim 4, wherein said prescribed range is altered based on a kind of the transfer medium.

9. An image forming apparatus, comprising:

an photosensitive member;

image forming means that forms a toner image on the photosensitive member;

transfer means for electrically transferring the formed toner image onto a transfer medium;

a power supply for supplying electrical power to the transfer means;

current detecting means for detecting a transfer current to be applied the transfer means;

voltage detecting means for detecting a transfer voltage to be applied the transfer means;

fixed-voltage transfer control means for controlling the power supply such that the detected transfer voltage will be maintained at a prescribed voltage;

fixed-current transfer control means that controls the power supply such that the detected transfer current will be maintained at a prescribed current; and first switching means for, when the detected transfer current falls outside a prescribed range, switching control from control by the fixed-voltage transfer control means to control by the fixed-current transfer control means.

10. An image forming apparatus of claim 9, further comprising:

second switching means that returns control from control by the fixed-current transfer control means to control by the fixed-voltage transfer control means.

11. An image forming apparatus of claim 10, wherein said fixed-voltage transfer control means, after said second switching means returns control to control by the fixed-voltage transfer control means, control a transfer voltage such that the detected transfer voltage will be maintained at a transfer voltage which has been detected under the control by the fixed-current transfer control means.

12. An image forming apparatus of claim 9, further comprising:

third switching means that, where a transfer voltage detected during the fixed-current transfer control exceeds a prescribed threshold voltage, sets said prescribed threshold voltage as a new control voltage, and then returns control to the fixed-voltage transfer control by said fixed-voltage transfer control means.

13. An image forming apparatus of claim 9, wherein said prescribed range is altered based on a kind of the transfer medium.

* * * * *